United States Patent [19]

King

[11] Patent Number: 4,747,304

[45] Date of Patent: May 31, 1988

[54] BUNDLE CARRIER

[75] Inventor: Lance M. King, Garden Grove, Calif.

[73] Assignee: V. E. Kuster Company, Long Beach, Calif.

[21] Appl. No.: 920,371

[22] Filed: Oct. 20, 1986

[51] Int. Cl.[4] ..... E21B 49/08

[52] U.S. Cl. ..... 73/155

[58] Field of Search ..... 73/155, 866.5, 152, 73/154; 175/40, 48, 50

[56] References Cited

U.S. PATENT DOCUMENTS 2,198,821 4/1940 Jessup ..... 73/155 U X

FOREIGN PATENT DOCUMENTS 901482 1/1982 U.S.S.R. ..... 73/155

*Primary Examiner*—Jerry W. Myracle

*Attorney, Agent, or Firm*—Grant L. Hubbard

[57] ABSTRACT

A downhole bundle carrier on which an instrument support leg is pivotally mounted. A fluid passageway extends from the inside of the bundle carrier through the pivot joint and extends to the distal end of the instrument support leg. A cleanout passageway extends from the fluid passageway to the exterior of the bundle carrier.

11 Claims, 2 Drawing Sheets

BUNDLE CARRIER

FIELD OF THE INVENTION

This invention relates to apparatus for drilling oil wells, gas wells and the like and, more specifically, to apparatus commonly known in the industry as bundle carriers, a particular improved version of a bundle carrier being disclosed and claimed.

BACKGROUND OF THE INVENTION

In drilling, drill stem testing and in the maintenance of oil and gas wells and for other deep well bores in the earth, it is necessary to introduce test instruments into the bore hole. Bundle carriers are commonly used to carry instruments of various types downhole. These bundle carriers comprise, in general configuration, an elongate section of the drill string, threaded at either end to interconnect with other elements of the drill string, having a passageway therethrough for introducing or extracting fluids, for dropping measuring instruments and the like down into the hole, etc., all as well known in the art. In one form, these bundle carriers comprise a slot or a plurality of slots running longitudinally along the outside of the bundle carrier for receiving instruments. These slots may be as much as four, six or more feet long and, generally, are from one and a half to two and a half inches in diameter to receive various sizes of instruments. Pressure, flow, temperature and other measuring instruments are fitted into these slots. Means are provided for communicating fluid or a fluid signal through the walls of the bundle carrier or through portions of the bundle carrier to sample either the fluid conditions inside the flow passageway or on the outside of the bundle carrier, or both. In the past, it has been conventional to provide a system for inserting an instrument into one or more of these slots, twisting it or otherwise fitting it into a socket or fitting in the bundle carrier and then locking it in place using a locking ring or some other method of locking it in the slot of the bundle carrier. Such a structure is described by patent application Ser. No. 648,513, filed Sept 10, 1984, entitled ECCENTRIC BUNDLE CARRIER, the inventor of which is Stephen H. Ficken.

Bundle carriers of this type are in common use throughout the world and are well known and understood in the art. Fundamentally, the bundle carrier comprises means for connecting an elongate measuring instrument in one or more elongate slots therein and means for permitting fluid communication with the instrument.

SUMMARY OF THE INVENTION

The invention disclosed herein, and exemplified in the detailed description and the drawings, without limitation thereto, is an improved downhole bundle carrier having means for connecting an elongate measuring instrument in one or more elongate slots therein and means for permitting fluid communication with such instrument, wherein the means for permitting fluid communication with the instrument comprises support means forming a passageway extending from either interior or exterior of the bundle carrier, and pivotal instrument support means forming a fluid communication passage having one end connected to the support means and another end adapted to be connected to the instrument for fluid communication therewith. The passage in the pivotal support means forms a fluid communication path from the passageway in the support means through the pivotal support means to permit fluid communication from either the interior or the exterior of the bundle carrier, or both the interior and the exterior, to the instrument when the bundle carrier is in use. The pivotal support means, which may be integral with either the instrument or the bundle carrier, but is most conveniently a separate component, is so configured and assembled with the support means of the bundle carrier as to permit the instrument to be connected thereto in non-parallel relationship to the axis of the bundle carrier and to be pivoted into a substantially parallel relationship in a slot in the bundle carrier.

The bundle carrier comprises, in a preferred form, pivotal sealing means for forming a fluid tight seal during rotation and in use downhole between the support means passageway and the instrument. An "O" ring seal on the support means in a mating opening in either the bundle carrier or the instrument connection fitting, or both, is a preferred form of seal.

The bundle carrier preferable also has in the support means thereof a cleanout passageway extending substantially linearly from said passageway therein to the exterior of the bundle carrier and removable closing means for closing the cleanout passageway, the closing means being removable to permit access to the passageway to insert an instrument and/or apply direct pressure, fluid or otherwise to clean out the passageway.

The bundle carrier conveniently has a second pivotal instrument support means forming a fluid communication passage having one end connected to the support means and another end adapted to be connected to the instrument for fluid communication therewith, the passage in the pivotal support means forming a fluid communication path from the passageway in the support means therethrough to permit fluid communication from either the interior or the exterior, or both, of the bundle carrier to the instrument when the bundle carrier is in use.

The pivotal instrument support is, in one preferred form, a generally "L" shaped fitting having a short leg connected, either rigidly or pivotally, to the bundle carrier support means and a long leg, substantially at right angles to the short leg, adapted to be connected to the instrument. The long leg is connected to the short leg of the pivotal instrument support either pivotally or rigidly to allow the previously mentioned pivotal movement. The short leg can be pivotally connected to either or both of the bundle carrier support means and the long leg to allow relative pivotal movement between the bundle carrier and the long leg and, when in use, the instrument. Also in a preferred form, the long leg has means for accepting and interconnecting with known, standard instruments currently in use in the industry, such as those made by the Kuster Company and/or GRC Corporation, for example. The bundle carrier preferably comprises pivotal sealing means for forming a fluid tight seal during rotation and use downhole between the support means passageway and the instruments. The sealing means is, conveniently, an "O" ring in an opening in the bundle carrier support means and/or the long leg adapted to receive an insertable portion of the short leg, the "O" ring forming a seal between the insertable portion and the walls of the opening.

It should be clearly understood, however, that specific connection means, sealing means, etc. are not the essence of the present invention and a great many variations thereof and different structures may be used without departing from the scope of the invention, respecting which the drawings and the preferred embodiment are only exemplary and not limiting.

DETAILED DESCRIPTION OF THE PREFERRED EMBODIMENT

An exemplary embodiment of the present invention is illustrated in the figures. It is to be understood, however, that this is merely and exemplary embodiment and not limiting.

Figure 1:
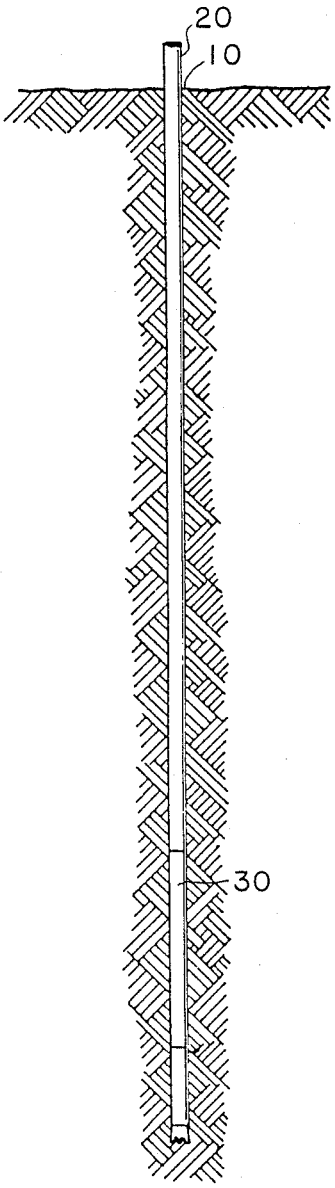
FIG. 1 is a generalized depiction of a deep earth drill hole and drill stem showing the bundle carrier of this invention.

In FIG. 1, the earth having a bore hole 10, receiving a casing or drill stem 20, includes a bundle carrier 30.

Figure 2:
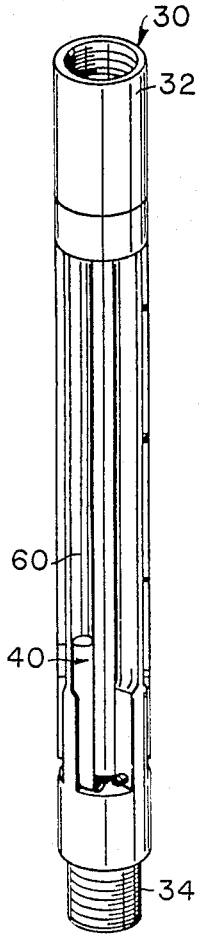
FIG. 2 is a side perspective view of the bundle carrier of this invention.

The bundle carrier 30 is shown in FIG. 2 and comprises, as is generally the case with bundle carriers, ends 32 and 34 adapted to be connected, usually by threads, with other components of the drill string. As shown in FIG. 2, the bundle carrier also has in it an instrument 60. Several instruments may be carried in a single bundle carrier. The bundle carrier shown in FIG. 2 also has the long leg of the improved invention of this application designated at numeral 40.

Figure 3:
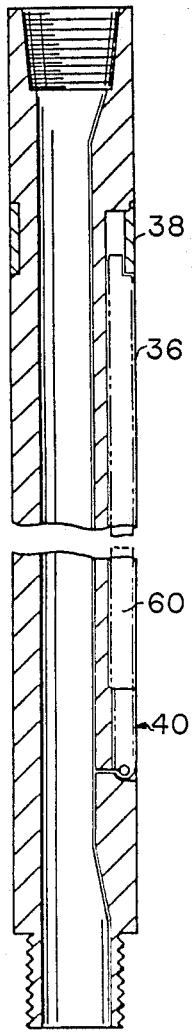
FIG. 3 is a vertical, cross-sectional view of the bundle carrier of this invention, being configured after the eccentric bundle carrier of Ficken, U.S. patent application Ser. No. 648,513, though any bundle carrier may be configured to embody the present invention.

Referring now to FIG. 3, the bundle carrier also includes one or more slots 36 and some locking mechanism such as a locking ring 38. Any locking mechanism or any kind of device to hold the instruments in the slots is quite satisfactory. Indeed, it would be possible to operate without such a mechanism although it would not necessarily be wise to do so.

The instrument 60, connected at one end to the long arm of the pivot support 40, is also shown in the slot 36.

Figure 4:
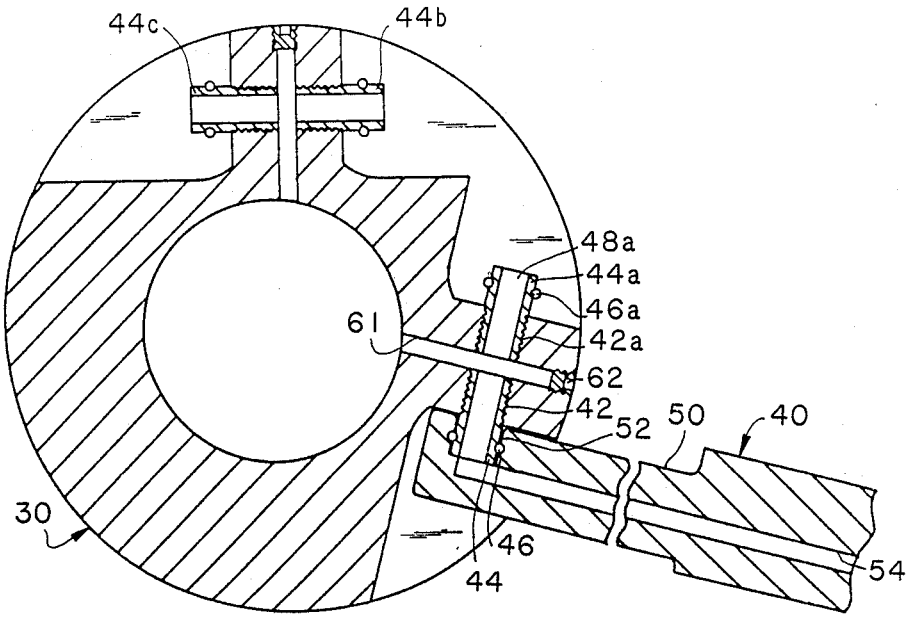
FIG. 4 is a cross-sectional view of the bundle carrier of this invention taken at the point where the pivotal support means engages in the bundle carrier.

Referring now to FIG. 4, details of the improved pivotal instrument support means of this invention are shown.

The improved pivotal support means generally indicated at 40 includes, in the exemplary form indicated, short leg 42 which is threaded and received or connected to a support means formed as part of the bundle carrier. As illustrated, the short leg is rigidly connected by threading in bundle carrier support means, but it could be connected by a pivotal connection such as is shown with respect to the long leg, to be described.

The other end of the short leg 42, said other end being shown at 44, extends into an opening in the long leg 50, the opening being shown at 52. Preferably some sealing mechanism such as an "O" ring 46 is provided to provide a fluid tight seal during pivoting and use. The short leg 42 also includes a passageway 48 which is in fluid communication with a passageway 54 in the long leg 50 and also with a passage 61 which extends, as illustrated to the interior of the bundle carrier. The passageway 61 also extends to the exterior of the bundle carrier, thus making it possible to sample the fluid in either the interior or the exterior of the bundle carrier. As illustrated, however, the passageway is closed by a threaded plug 62. The passageway 61 also comprises a cleanout passageway extending substantially linearly from the passageway for sampling to the exterior of the bundle carrier and a removable closing means 62 for closing the cleanout passage. In the illustrated embodiment, the fluid communication passage and the cleanout passage are formed in one drill hole, but this is not necessary to the invention.

The long leg of the instrument support means is pivotally connected to the support means of the bundle carrier by means of the short leg. The short leg may be pivotally connected to either the long leg or to the support means of the bundle carrier or pivotally connected to both. The distal end of the instrument support means is adapted to receive and be connected with the instrument, which may be any of the conventional downhole measuring instruments. This is typically a threaded connection, but a simple insert connection with fluid sealing means, etc., is all that is required. The fluid passage 54 in the long leg communicating with the passageway 48 in the short leg and the passage 61 places the instrument in fluid communication with either the fluid inside or outside of the bundle carrier or with fluids from both the inside and the outside, as may be desired, and depending upon the presence or absence of the plug 62. The plug 62 may, of course, be used to plug off the interior as well as the exterior of the bundle carrier.

Figure 5:
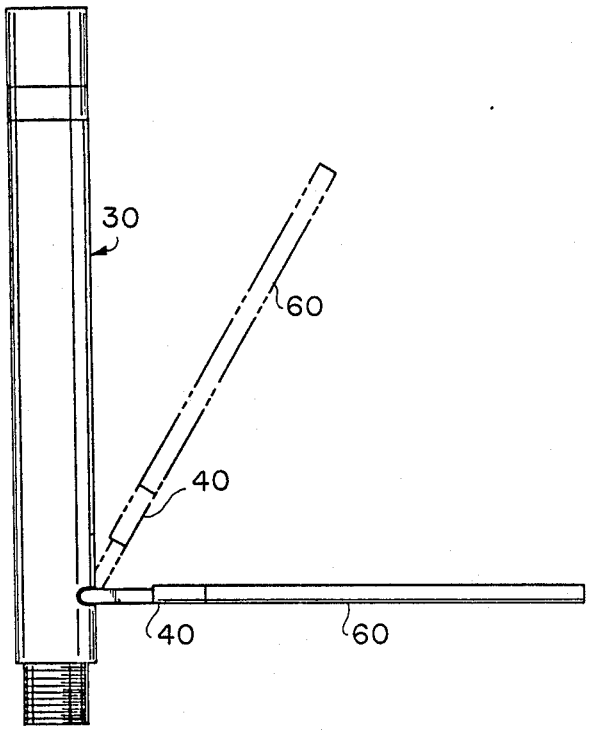
FIG. 5 is an elevational view of the bundle carrier showing the configuration of the instrument during installation and, in dashed lines, being prepared for use in the bundle carrier.

Referring now to FIG. 5, in use, the instrument is connected to the long leg of the bundle carrier support means of this invention and the long leg is connected to the short leg of the pivotal instrument support means of this invention, and the instrument with the long leg is then pivoted upwardly, as shown in dashed lines in FIG. 5, and ultimately into the slot in the bundle carrier where it is retained by any desired mechanism.

The disclosed mechanism provides many important advantages. It permits clean out of the passageways, it permits the bundle carrier to be more easily cleaned and repaired, it permits the instrument to be attached outside the slots, making the instrument more readily available for adjustment, tightening and other working, and provides a far more convenient and time saving means for accomplishing a change in instruments.

It will be understood that where the cost of drilling and measuring runs into the thousands of dollars per hour, the saving of time becomes a very, very important factor. The present invention is a great time saver. In addition, it permits the repair, refurbishing, cleaning and general maintenance of the bundle carrier and the instrument connecting means to be carried out more effectively and more efficiently and in the field, rather than having to ship the instruments, etc., back to the shop.

All of these advantages, and others, have been obtained through this design. It is contemplated that many variations from the specific embodiments, many sealing, pivoting, and other mechanisms may be used, and many instrument connectors and adapters may be used without departing from the spirit and scope of the invention as defined in the claims.

Industrial Application

This invention finds application in oil well, gas well and other deep drilling industries.

What is claimed is:

1. In a downhole bundle carrier having means for connecting an elongate measuring instrument in one or more elongate slots therein and means for permitting fluid communication with such instrument, the improvement wherein the means for permitting fluid communication with the instrument comprises:

support means forming a passageway extending from either interior or exterior of the bundle carrier; and pivotal instrument support means forming a fluid communication passage having one end connected to the support means and another end adapted to be connected to the instrument for fluid communication therewith, the passage in the pivotal support means forming a fluid communication path from the passageway in the support means therethrough to permit fluid communication from either the interior or the exterior of the bundle carrier to the instrument when the bundle carrier is in use; the pivotal support means being so configured and assembled with the support means of the bundle carrier as to permit the instrument to be connected thereto in non-parallel relationship to the axis of the bundle carrier and to be pivoted into a substantially parallel relationship in a slot in the bundle carrier.

2. The bundle carrier of claim 1 further comprising pivotal sealing means for forming a fluid tight seal during rotation and in use downhole between the support means passageway and the instrument.

3. The bundle carrier of claim 1 having formed in the support means a cleanout passageway extending substantially linearly from said passageway therein to the exterior of the bundle carrier and removable closing means for closing the cleanout passageway.

4. The bundle carrier of claim 1 having a second pivotal instrument support means forming a fluid communication passage having one end connected to the support means and another end adapted to be connected to the instrument for fluid communication therewith, the passage in the pivotal support means forming a fluid communication path from the passageway in the support means therethrough to permit fluid communication from either the interior or the exterior of the bundle carrier to the instrument when the bundle carrier is in use; the pivotal support means being so configured and assembled with the support means of the bundle carrier as to permit the instrument to be connected thereto in non-parallel relationship to the axis of the bundle carrier and to be pivoted into a substantially parallel relationship in a slot in the bundle carrier.

5. The bundle carrier of claim 4 further comprising pivotal sealing means for forming a fluid tight seal during rotation and in use downhole between the support means passageway and the instruments.

6. The bundle carrier of claim 5 having formed in the support means a cleanout passageway extending substantially linearly from said passageway therein to the exterior of the bundle carrier and removable closing means for closing the cleanout passageway.

7. The bundle carrier of claim 4 having formed in the support means a cleanout passageway extending substantially linearly from said passageway therein to the exterior of the bundle carrier and removable closing means for closing the cleanout passageway.

8. The bundle carrier of claim 4 wherein the pivotal support means comprises a substantially "L" shaped assembly having a short leg and a long leg disposed at angles to one another, the passageway extending through both legs, the short leg being pivotally connected to the bundle carrier support means or to the long leg, or to both the bundle carrier support means and the long leg.

9. The bundle carrier of claim 8 further comprising pivotal sealing means for forming a fluid tight seal during rotation and in use downhole between the support means passageway and the instruments.

10. The bundle carrier of claim 9 having formed in the support means a cleanout passageway extending substantially linearly from said passageway therein to the exterior of the bundle carrier and removable closing means for closing the cleanout passageway.

11. The bundle carrier of claim 8 having formed in the support means a cleanout passageway extending substantially linearly from said passageway therein to the exterior of the bundle carrier and removable closing means for closing the cleanout passageway.

* * * * *